US012173482B2

(12) United States Patent
Lenard

(10) Patent No.: US 12,173,482 B2
(45) Date of Patent: Dec. 24, 2024

(54) DEVICES AND SYSTEMS FOR FLUID STORAGE AND TRANSPORT

(71) Applicant: Roger X. Lenard, Edgewood, NM (US)

(72) Inventor: Roger X. Lenard, Edgewood, NM (US)

( * ) Notice: Subject to any disclaimer, the term of this patent is extended or adjusted under 35 U.S.C. 154(b) by 61 days.

(21) Appl. No.: 18/092,909

(22) Filed: Jan. 3, 2023

(65) Prior Publication Data

US 2024/0218639 A1 Jul. 4, 2024

(51) Int. Cl.
*E03B 11/00* (2006.01)
*B65D 88/16* (2006.01)

(52) U.S. Cl.
CPC ..... *E03B 11/00* (2013.01); *B65D 88/1606* (2013.01)

(58) Field of Classification Search
CPC ..... E03B 11/00; B65D 88/1606
USPC ..... 220/9.1
See application file for complete search history.

(56) References Cited

U.S. PATENT DOCUMENTS 5,024,346 A * 6/1991 Roser ..... B65D 77/0453 222/105
6,113,270 A * 9/2000 Hafer ..... B65D 88/1625 220/9.1
7,296,374 B2 * 11/2007 Weyrauch ..... G09F 7/18 220/9.1
7,648,040 B2 * 1/2010 Przytulla ..... B65D 19/06 220/23.91
2004/0089569 A1 * 5/2004 Chang ..... A63B 55/40 211/70.2
2009/0152151 A1 * 6/2009 Schubbach ..... B32B 27/06 220/9.1
2009/0230017 A1 * 9/2009 Schutz ..... B65D 77/0466 220/9.1
2012/0279959 A1 * 11/2012 Clive-Smith ..... B65D 88/02 220/9.4

FOREIGN PATENT DOCUMENTS

WO WO-2007029011 A1 * 3/2007 ..... B65D 77/061
WO WO-2007055692 A1 * 5/2007 ..... B65D 77/061

* cited by examiner

*Primary Examiner* — J. Gregory Pickett
*Assistant Examiner* — Niki M Eloshway
(74) *Attorney, Agent, or Firm* — Outer Space IP

(57) ABSTRACT

Systems and devices for storing a fluid in a reinforced bladder is disclosed. A flexible bladder is configured to store the fluid. An exoskeleton is configured to conform to and protect the flexible bladder on all sides. The combination of the flexible bladder and the exoskeleton results in the reinforced bladder.

12 Claims, 3 Drawing Sheets

DEVICES AND SYSTEMS FOR FLUID STORAGE AND TRANSPORT

TECHNICAL FIELD

The present disclosure relates generally to devices and systems for fluid storage and transport.

BACKGROUND

Significant areas of the world experience annual flooding even as equally significant portions of the world experience drought. The ability to mitigate both conditions is of great importance to the world.

SUMMARY

In a first aspect, the disclosure provides a device for storing a fluid. The device has a flexible bladder and an exoskeleton that surrounds the flexible bladder on all sides.

In a second aspect, the disclosure provides a system for storing a fluid in a reinforced bladder. A flexible bladder is configured to store the fluid. An exoskeleton is configured to conform to and protect the flexible bladder on all sides. The combination of the flexible bladder and the exoskeleton results in the reinforced bladder.

In a third aspect, the disclosure provides a system for power load balancing. A flexible bladder at a high elevation is configured to receive a fluid by pumping from a fluid source at a low elevation during low power load. An exoskeleton is configured to conform to and protect the flexible bladder on all sides, the combination of the flexible bladder and the exoskeleton resulting in a reinforced bladder. The reinforced bladder is configured to return the fluid through a turbine to the fluid source to produce power during high power load.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
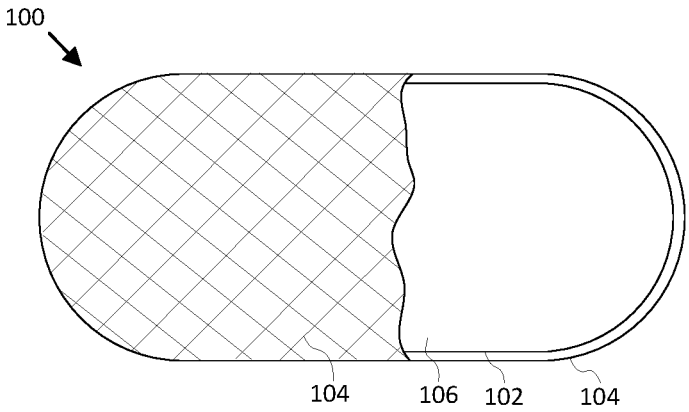
FIG. 1 is a side view with cutaway of a reinforced bladder.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, piping includes penstock, tubing, or any other means of transporting enclosed fluids.

As used herein, an exoskeleton is a structure that provides external rigidity, structure, and protection to a flexible inner object, and further is not a contiguous material, as in a cloth bag or tank, but rather set of discrete supports that are connected to support what is inside the exoskeleton. Examples include a mesh, a lattice, grid, grill, grate, net, frame, skeleton, carapace, or similar. The exoskeleton may be rigid or flexible Water systems are one of the great resource balancing acts of the modern age. While food resources have easily kept ahead of population growth, limited only by supply chains and logistics, water is not a commodity that is simple or energetically favorable to transfer from areas of abundance to areas of need. With a sufficient power supply, such as nuclear or other renewable power, the present invention is able to easily overcome this water balancing act.

Flexible bladders by themselves are not able to be deployed in the wilds of the U.S. or other countries because of the ease at which the bladders can be popped by rocks, sticks, wild animals, and even hail. The present invention overcomes this by deploying the flexible bladders with an exoskeleton that supports and reinforces the bladders, providing external rigidity, structure, and protection to the bladders. As such, these can be deployed either as long term or short-term storage systems into even the most remote areas of the wilds.

With these reinforced bladders now available due to the present invention, multiple benefits can be realized. The water systems of the world can be balanced. Local power grids can be load balanced. And rather than build reservoirs that permanently alter the landscape, these reinforced bladders can be deployed with no modification to the local environment and be removed when the demand is complete, leaving no trace behind.

In the case of load balancing of energy grids, the reinforced bladders can be used at elevation to provide low demand electricity storage as potential energy storage of water and then conversion of the potential energy back into electricity during high demand, generating revenue for local investors.

During times of flooding, water can be moved via a series of reinforced bladders. A pump can send the flood water to the first reinforced bladder, placed near the flooding area. The series of reinforced bladders each has a pump that pumps the water on. The flood water can thereby be pumped rapidly through the bladders to another destination, preferably a drought area or another water demand area, mitigating the flood while also putting the water somewhere that it is useful and not harmful. This is the embodiment that would most benefit from nuclear power or renewable power that can provide the energy needed to pump the large quantities of water a flood produces. Once the flood is over, the reinforced bladders can be removed and the landscape returned easily to its pre-utilization condition. In a preferred embodiment, the first bladder or first few bladders may be filled directly from spillway runoff, minimizing pumping requirements. Capture of spillway runoff before flood waters form prevents flooding and minimizes power use.

Further, the same concept of a series of reinforced bladders with pumps can be used to pump water to wilderness areas, either from flood waters or from another water source. The water can be utilized in the wilderness area for supplying water to fire fighters or other wilderness demands. Other utilization options are detailed below.

The wilderness areas utilized may be unused federal or state lands and permitting should be relatively simple as no permanent damage to the land will occur by the occupancy. No concrete should be required, and no overburden needs to be moved to accommodate the system. The overall system is minimally environmentally invasive, as the removal of the bladder removes the change to the environment.

The flexible bladders can easily be made out of environmentally safe geomembranes, preventing the waters pumped from being polluted further by undesirable chemicals. Further, geomembranes are typically puncture resistant, meaning the reinforcement from the exoskeleton will make the reinforced bladders extremely durable. This invention can be leak proof and evaporation proof.

Any type of water can be utilized, as detailed below. This can include pumping from underground aquifers, reservoirs, rivers, or similar. Further, other fluids can also be utilized, including brine, wastewater, contaminated water, hydrocarbons, ammonia, nitrogenous compounds, non-organic fluids, and combinations thereof.

Now referring to FIG. 1, FIG. 1 is a side view with cutaway of a reinforced bladder that may be used in one embodiment of the present invention. At 100, a flexible bladder 102 is contained inside of and supported by an exoskeleton 104. A fluid 106 inside the bladder 102 fills the bladder until it reaches the extent of the exoskeleton 104. In one embodiment, the exoskeleton 104 is rigid and retains shape while the bladder 102 expands and contracts as the fluid 106 is pumped in. In other embodiments, the exoskeleton 104 is not as rigid and at least partially collapses as the bladder 102 is emptied. In other embodiments, the bladder 102 is attached to the exoskeleton 104 and retains the shape of the exoskeleton 104 as the fluid 106 flows in and out of the bladder 102. In this last embodiment, air is allowed to enter and exit to retain pressure.

In some embodiments, the fluid is selected from a group consisting of water, brine, wastewater, contaminated water, hydrocarbons, and combinations thereof.

In some embodiments, the flexible bladder comprises a material selected from HDPE (high-density polyethylene), LDPE (low-density polyethylene), MDPE (mid-density polyethylene), blended plastic polymers, metal, and combinations thereof.

In some embodiments, the exoskeleton comprises a metal mesh, a fabric mesh, a plastic mesh, or a composite mesh.

In a preferred embodiment, the flexible bladder fully encloses the fluid.

Figure 2:
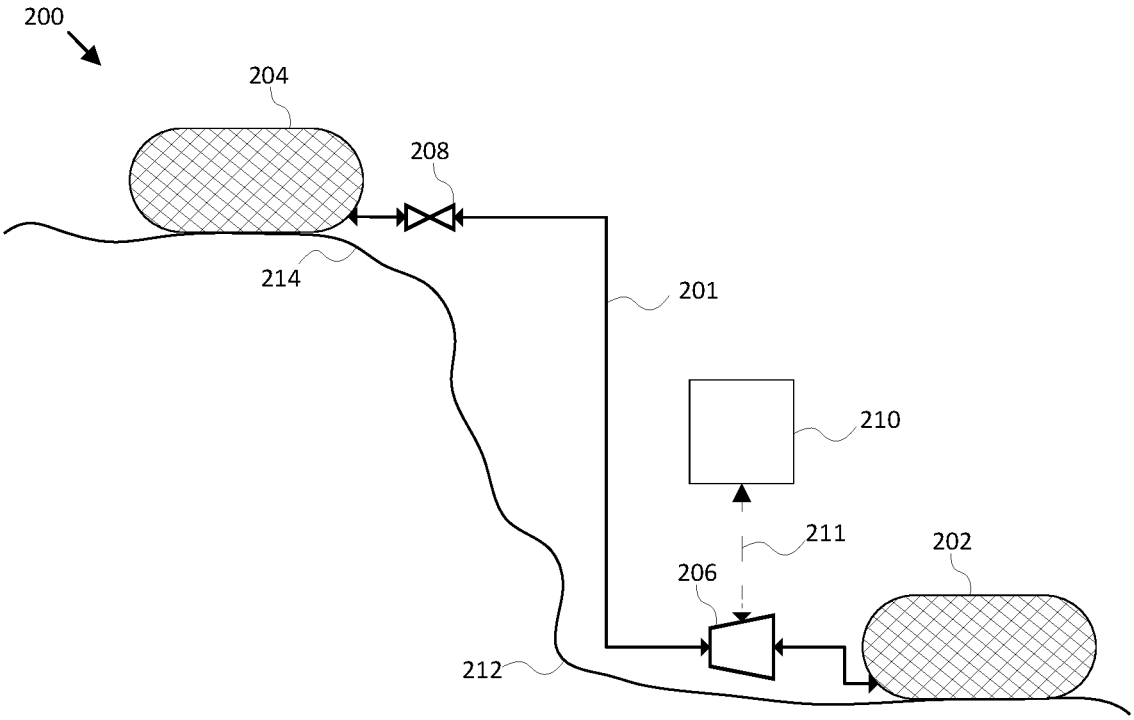
FIG. 2 is a process flow diagram of a system for storing and transporting fluids.

FIG. 2 is a process flow diagram of a system for storing and transporting fluids that may be used in one embodiment of the present invention, as shown at 200. A first reinforced bladder 202 is at elevation 212. A second reinforced ladder 204 is at a higher elevation 214. The power grid 210 has peaks of consumption and low consumption periods. During peak periods, demand is high and power is required and more expensive. During low periods, demand is low and power is not required and is less expensive. During the low periods, a fluid is pumped from reinforced bladder 202 by pump/turbine 206 using power 211 through piping 201 to reinforced bladder 204. This stores the cheaper power as potential gravitational energy in reinforced bladder 204. During peak periods, valve 208 is then opened and pump/turbine 206 is used to produce power 211 and send it back to the power grid 210.

In some embodiments, the first or second reinforced bladders can be replaced by a water source such as a river or reservoir.

Figure 3:
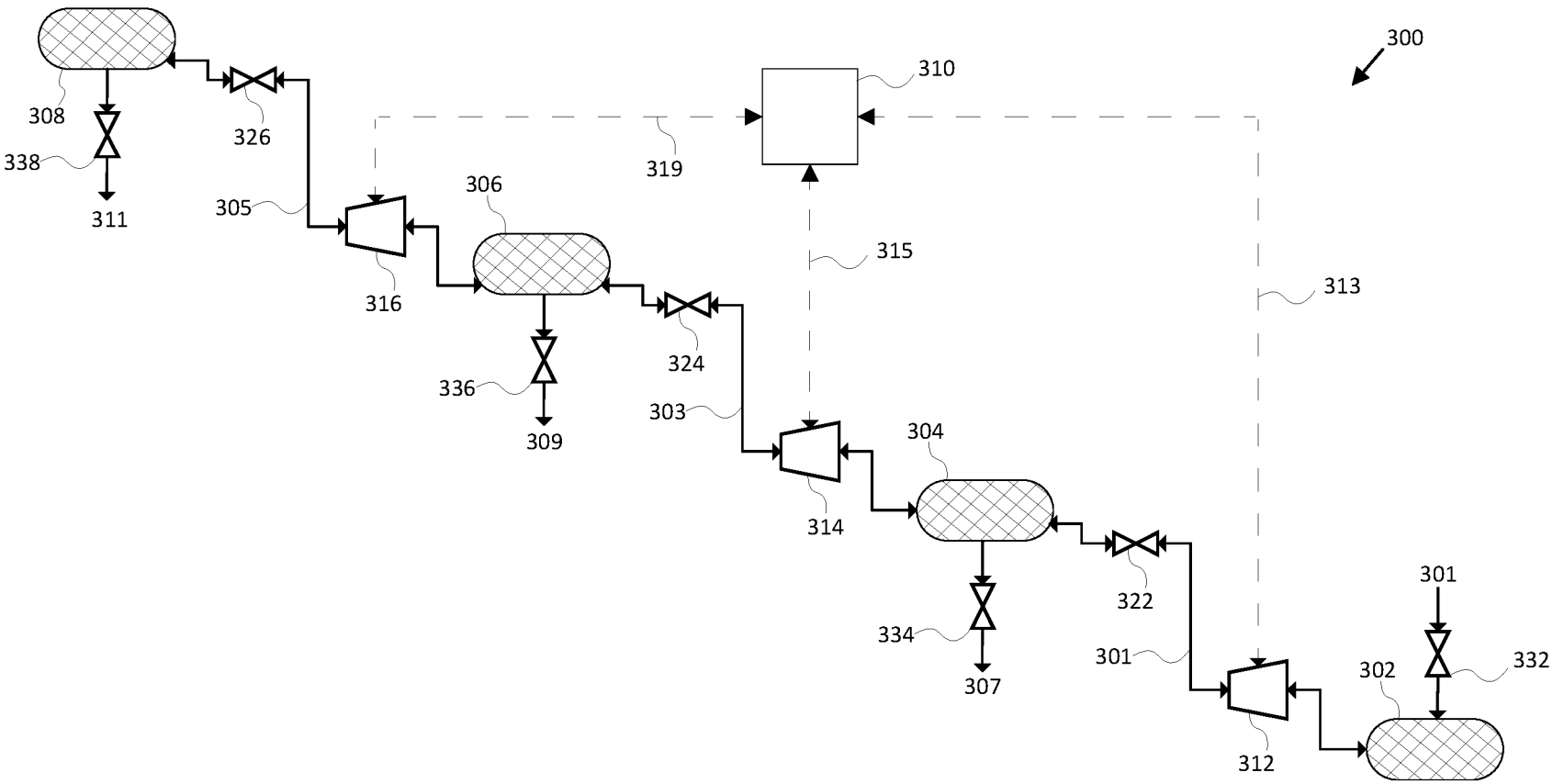
FIG. 3 is a process flow diagram of a system for storing and transporting fluids.

FIG. 3 is a process flow diagram of a system for storing and transporting fluids that may be used in one embodiment of the present invention as shown at 300. A series of reinforced bladders extend from a low elevation stepwise to a higher elevation. The first reinforced bladder 302 receives a fluid 301 through valve 332.

In a first embodiment, fluid 301 is flood water and the user desires the flood water to be transported to an area in need of water, such as a drought area or navigable river below navigation depth. In this embodiment, the fluid 301 is pumped by pump/turbine 312 through piping 301 to the second reinforced bladder 304. The fluid 301 is pumped by pump/turbine 314 through piping 303 to the third reinforced bladder 306. The fluid 301 is pumped by pump/turbine 316 through piping 305 to the last reinforced bladder 306. The fluid 301 is then released as fluid 311 through valve 338 to the area in need of water.

In this embodiment, fluid 301 may also be removed from the second and third reinforced bladders 304 and 306 through valves 334 and 336 as fluid 307 and 309, respectively. This water may be used for firefighting, irrigation, campers, emergency responders, or combinations thereof.

In some embodiments, the reinforced bladders are at the same or similar elevations. In a preferred embodiment, the first reinforced bladder 302 is at the elevation of a water source such as a flooding river and the last reinforced bladder 308 is at the elevation of water sink, such as a drought area or a river that is below navigable levels.

In an alternative embodiment, the system may be used for storing power during low power usage and producing power during high power usage, as in FIG. 2. In this embodiment, the fluid 301 is pumped as described previously during low power usage and is then allowed to drain back down through valves 322, 324, or 326 during high power usage through pump/turbines 312, 314, and 316 to produce power 313, 315, and 319, respectively.

In an alternative embodiment, the fluid source is a pipeline and the fluid is a compressed gas such as natural gas. The fluid 301 is allowed to enter the first reinforced bladder 302 through valve 332 while the pipeline is at a high pressure, allowing for increased storage capacity of the pipeline fluid. The fluid 301 is discharged back into the pipeline by valve 332 when the pipeline is at a low pressure, allowing for balancing of fluid supply in the pipeline.

In some embodiments, a pit is configured to contain the reinforced bladder.

In some embodiments, the reinforced bladder is configured to receive spills, including toxic waste, industrial runoff, flood waters, spilled oil, rain, and combinations thereof.

In some embodiments, the exoskeleton is a metal mesh made of fine gauge wires. In other embodiments, the metal mesh is made of heavier gauge wires. In some embodiments, the mesh may be made from composite wires.

Figure 4:
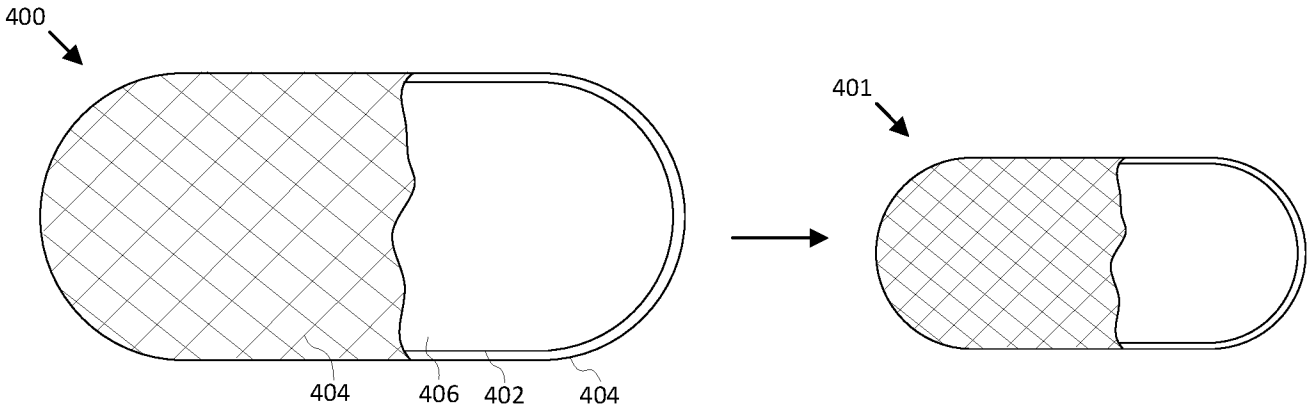
FIG. 4 is a side view with cutaway of a reinforced bladder.

Now referring to FIG. 4, FIG. 4 is a side view with cutaway of a reinforced bladder that may be used in one embodiment of the present invention. At 400, a flexible bladder 102 is contained inside of and supported by an exoskeleton 404. The exoskeleton 404 is a Kevlar fabric mesh that supports the bladder when fully expanded with both structural strength and physical protection. At 400, a fluid 406 has filled the bladder 402 to the extent of the flexibility of the exoskeleton 404. At 401, the bladder is being drained (or filled) and the exoskeleton 404 collapses as it is not required to support the bladder during filling or deflation.

In all embodiments, the tensile strength of the bladder and exoskeleton combination is sufficient to support the column of water that is produced by filling the bladder. In a preferred embodiment, this is at least 20 to 30 feet of water, though greater heights can be accommodated. In some embodiments, the exoskeleton provides rigidity and structure and the bladder merely fills or empties the space inside the exoskeleton. In other embodiments, the exoskeleton collapses when the bladder is not full.

In some embodiments, the exoskeleton consists of a fabric, such as Kevlar, configured to protect the flexible bladder from puncture, and a metal mesh or plastic mesh to provide support to the flexible bladder.

In some embodiments, bypass lines with appropriate valving are provided and configured to enable bypassing one or more reinforced bladders in the series of bladders. This allows repair, removal, inspection, and safety along the system.

The invention has been described with reference to various specific and preferred embodiments and techniques. Nevertheless, it is understood that many variations and modifications may be made while remaining within the spirit and scope of the invention.

What is claimed is:

1. A system for storing a fluid in a reinforced bladder comprising:

a flexible bladder configured to store the fluid; and an exoskeleton configured to conform to and protect the flexible bladder on all sides, the combination of the flexible bladder and the exoskeleton resulting in the reinforced bladder;

further comprising a plurality of reinforced bladders, a first reinforced bladder placed adjacent a fluid source, a last reinforced bladder placed adjacent a fluid demand location, and the remainder of the plurality of reinforced bladders placed between the first device and the last device, wherein each of the plurality of reinforced bladders are configured to store the fluid for transport;

piping connecting the plurality of reinforced bladders in series, the fluid source, and the fluid demand location, configured to carry the fluid from the fluid source to the fluid demand location; and a plurality of pumps configured to pump fluid from the fluid source to the first reinforced bladder, between each of the plurality of reinforced bladders, and from the last reinforced bladder to the fluid demand location.

2. The invention of claim 1, wherein the fluid is selected from a group consisting of water, brine, wastewater, contaminated water, hydrocarbons, and combinations thereof.

3. The invention of claim 1, wherein the flexible bladder comprises a material selected from HDPE, LDPE, MDPE, blended plastic polymers, metal, and combinations thereof.

4. The invention of claim 1, wherein the exoskeleton comprises a fabric mesh, a metal mesh, or a plastic mesh.

5. The invention of claim 1, wherein the exoskeleton comprises a fabric configured to protect the flexible bladder from puncture and a metal mesh or plastic mesh to provide support to the flexible bladder.

6. The invention of claim 1, wherein the flexible bladder is configured to fully enclose the fluid.

7. The invention of claim 1, further comprising a pit configured to contain the reinforced bladder.

8. The invention of claim 1, wherein the fluid is water and each of the plurality of reinforced bladders comprise a water spigot for providing water for a local demand comprising fire fighting, irrigation, campers, emergency responders, or combinations thereof.

9. The invention of claim 1, wherein the fluid is water and the fluid source is flood water and the water demand location is a drought area or normally navigable river that is below navigation levels.

10. The invention of claim 1, further comprising a pipeline configured to fill the reinforced bladder during high flow rates of the fluid and to empty the reinforced bladder during low flow rates of the fluid.

11. The invention of claim 1, wherein the reinforced bladder is configured to receive spills, comprising toxic waste, industrial runoff, flood waters, spilled oil, rain, and combinations thereof.

12. The invention of claim 1, wherein the reinforced bladder is configured to store floodwater.

* * * * *